US005180091A

United States Patent [19]

Ota

[11] Patent Number: 5,180,091

[45] Date of Patent: Jan. 19, 1993

[54] NAILING MACHINE

[75] Inventor: Hideo Ota, Anjo, Japan

[73] Assignee: Makita Corporation, Anjo, Japan

[21] Appl. No.: 800,102

[22] Filed: Nov. 29, 1991

[30] Foreign Application Priority Data

Nov. 30, 1990 [JP] Japan ..... 2-341141

[51] Int. Cl.[5] ..... B25C 1/04

[52] U.S. Cl. ..... 227/8; 227/120; 227/130

[58] Field of Search ..... 227/8, 120, 130

[56] References Cited

U.S. PATENT DOCUMENTS

| | | | |
|---|---|---|---|
| 3,464,614 | 9/1969 | Volkmann | 227/130 |
| 3,498,517 | 3/1970 | Novak | 227/130 |
| 3,563,438 | 2/1971 | Doyle et al. | 227/130 |
| 3,606,128 | 9/1971 | Cast et al. | 227/130 |
| 3,615,049 | 10/1971 | Obergfell et al. | 227/120 |
| 4,197,974 | 4/1980 | Morton et al. | 227/120 |
| 4,463,888 | 8/1984 | Geist et al. | 227/8 |

FOREIGN PATENT DOCUMENTS

| | | |
|---|---|---|
| 56-25827 | 6/1981 | Japan . |
| 2-28007 | 7/1990 | Japan . |

*Primary Examiner*—Douglas D. Watts
*Assistant Examiner*—Scott A. Smith
*Attorney, Agent, or Firm*—Dennison, Meserole, Pollack & Scheiner

[57] ABSTRACT

A nailing machine includes a driver guide mounted on a body. A driver is provided and is reciprocally movable within a nail guide channel formed within the driver guide. A nail magazine is mounted on the driver guide and includes therein a nail storing channel in communication with the nail guide channel. A pusher is disposed within the nail storing channel for pressing nails stored therein toward the nail guide channel. The pusher is movable within the nail storing channel according to the amount of nails stored within the nail storing channel. A trigger is mounted on the body and is operably by an operator to move between a starting position for actuating the drive device of the driver and a stopping position for stopping the same. A stopper is connected with the trigger and is movable between a first position corresponding to the starting position of the trigger and a second position corresponding to the stopping position. An engaging member is disposed within the nail magazine and is movable with the pusher. The engaging member is engageable with the stopper positioned at the second position so as to prevent movement of the trigger from the second position to the first position when the amount of the nails stored within nail storing channel is less than a predetermined amount.

3 Claims, 8 Drawing Sheets

NAILING MACHINE

BACKGROUND OF THE INVENTION

1. Field of the Invention

The present invention relates to a nailing machine and particularly to a nailing machine suitable to drive a thin nail used for an interior finishing work.

2. Description of the Prior Art

A conventional nailing machine includes a trigger mounted on a body for actuating a trigger valve. The trigger valve controls a nailing operation to be performed by a driver which is movable within a driver guide mounted on the body. A contact arm is slidably fitted on the driver guide and is operably connected with the trigger in such a manner that the nailing operation can not be performed unless the contact arm as well as the driver guide is moved to abut on a work into which a nail is to be driven. A pusher is disposed within a nail magazine mounted on the driver guide and is operable to supply the nails stored within the nail magazine one after another into a nail guide channel formed in the driver guide. The contact arm is also operably connected with the pusher in such a manner that the contact arm is mechanically prevented form moving to permit nailing operation when all of the nails stored in the nail magazine have been driven or when a few nails remain in the nail magazine. Such a conventional nailing machine is disclosed in Japanese Utility Model Publication No. 2-28007.

Japanese Utility Model Publication No. 56-25827 discloses a nailing machine which does not include a contact arm but includes an air control device. The air control device controls air to prevent a driver for driving a nail from actuation in spite of actuation of a trigger when no nail remains in a nail magazine.

With the former nailing machine constructed to mechanically prevent the contact arm from movement, when the machine is operated to continuously drive nails within short time intervals, it becomes possible to actuate the trigger even if the contact arm is prevented from movement. Therefore, an operator of the machine can not recognize that no nail remains in the nail magazine until he actuates the trigger for driving operation. Further, the contact arm as well as the work into which the nail is driven may be damaged since the contact arm abuts on the work with its movement prevented. This may cause unreliable operation of the contact arm.

With the latter nailing machine including the air control device, such provision of the air control device requires to additionally incorporate air channels, etc. which may result in a complicated structure of the machine and may cause loss of air.

Thus, the former and latter nailing machines can not satisfactory perform to prevent idle nailing operation.

SUMMARY OF THE INVENTION

It is, accordingly, an object of the present invention to provide a nailing machine which can be reliably operated to prevent the trigger from actuation.

It is another object of the present invention to provide a nailing machine which can be operated to prevent the trigger from actuation with a simple structure.

According to the present invention, there is provided a nailing machine comprising:

a body;

a driver guide mounted on the body which includes a nail guide channel therein;

a driver reciprocally movable within the driver guide by a drive device disposed within the body;

a nail magazine mounted on the driver guide and including therein a nail storing channel in communication with the nail guide channel;

a pusher disposed within the nail storing channel for pressing nails stored therein toward the nail guide channel in such a manner that the nails can be in turn driven out of the nail guide channel by the reciprocal movement of the driver, the pusher being movable within the nail storing channel according to the amount of nails stored within the nail storing channel;

a trigger mounted on said body and operable by an operator to move between a starting position for actuating the drive device of the driver and a stopping position for stopping the same;

a stopper operably connected with said trigger which is movable between a first position corresponding to the starting position of the trigger and a second position corresponding to the stopping position; and an engaging member disposed within the nail magazine and movable with the pusher, the engaging member being engageable with the stopper positioned at the second position so as to prevent movement of the trigger from the second position to the first position when the amount of the nails stored within nail storing channel is less than a predetermined amount.

The invention will become more fully apparent from the claims and the description as it proceeds in connection with the drawings.

DETAILED DESCRIPTION OF THE PREFERRED EMBODIMENT

Figure 1:
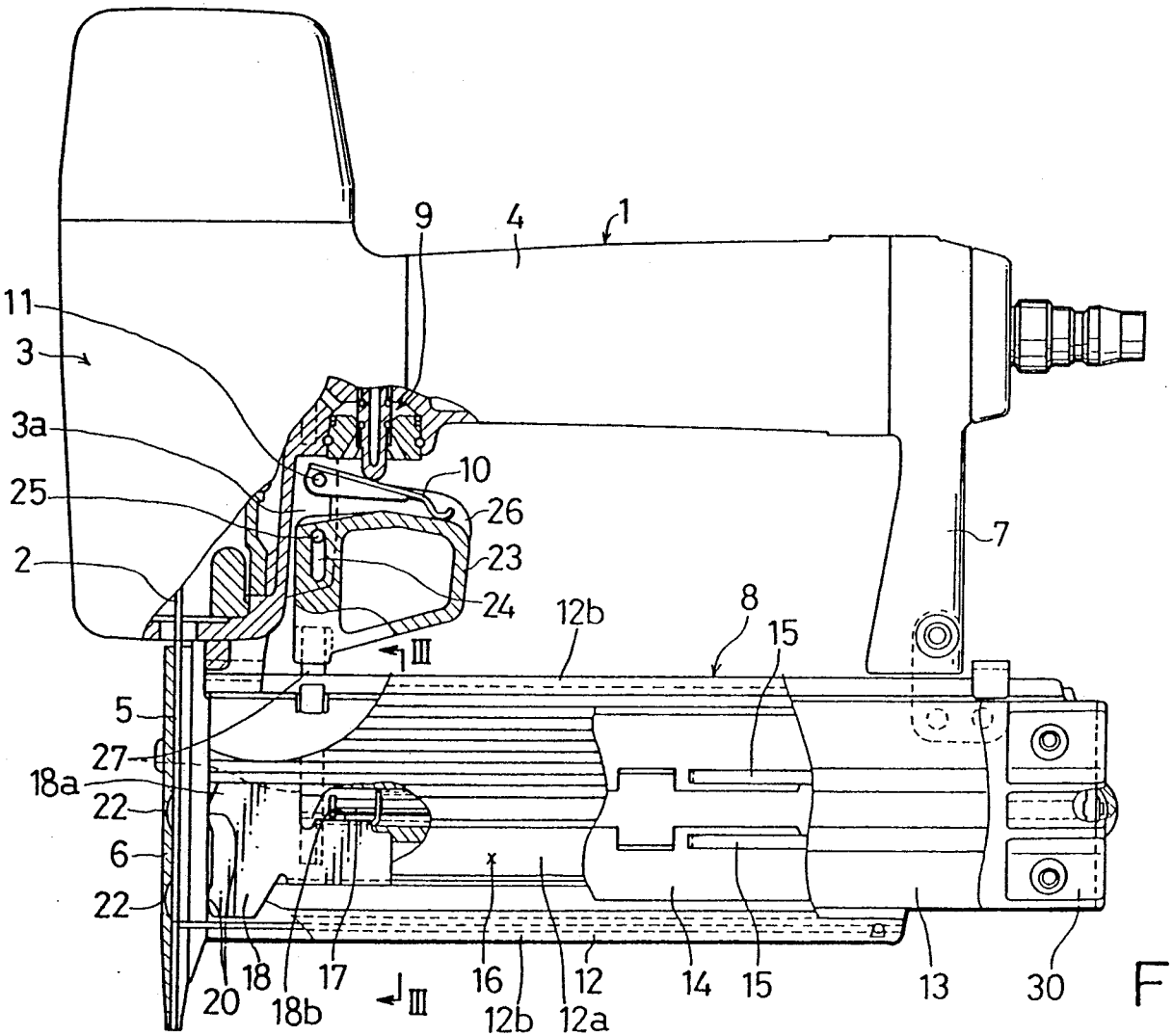
FIG. 1 is a right side view, with a part broken away, of a nailing machine according to a first embodiment of the present invention.

Referring to FIG. 1, there is shown a nailing machine 1 according to a first embodiment of the present invention. The nailing machine 1 includes a substantially cylindrical body housing 3 within which a driver 2 is movably mounted. The driver 2 is reciprocally movable within the body housing 3 by compressed air under the control of the pneumatic device (not shown) disposed within the body housing 3. A handle 4 is mounted on the body housing 3 perpendicular thereto. The handle 4 includes therein an air chamber connected with the pneumatic device and has a joining 4*a* at the rear end thereof for connection with a compressed air source through an air hose (not shown). A drive guide 6 is mounted on the bottom portion of the body housing 3 and extends downwardly therefrom. The driver guide 6 includes therein a nail guide channel 5 into which the driver 2 extends for reciprocal movement therewithin. A nail magazine 8 for storing nails S is disposed perpendicular to the driver guide 6. One end of the nail magazine 8 is connected with the driver guide 6 and is opened there for supplying nails S one by one to the nail channel 5. The other end of the nail magazine 8 is supported by a bracket 7 formed with the rear end of the handle 4.

A trigger valve 9 is mounted on the body housing 3 adjacent the forward end of the handle 4 for controlling supply of the air from the air chamber within the handle 4 to the pneumatic device disposed within the body housing 3. The trigger valve 9 is operable by a trigger 23 as will be hereinafter explained. An auxiliary trigger 10 is disposed below the trigger valve 9 and is pivotally mounted through a pin 11 on a support portion 3*a* formed integrally with the body housing 3.

Figure 3:
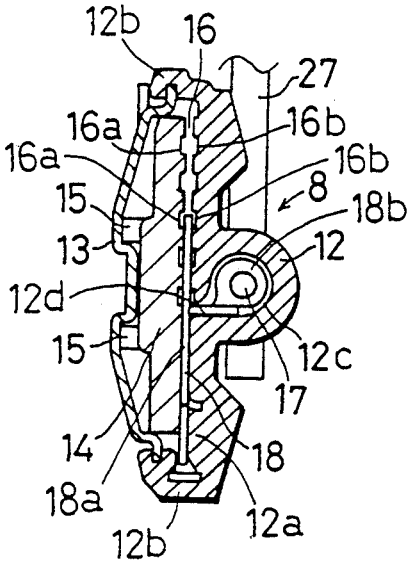
FIG. 3 is a sectional view taken along line III—III in FIG. 1.
Figure 2:
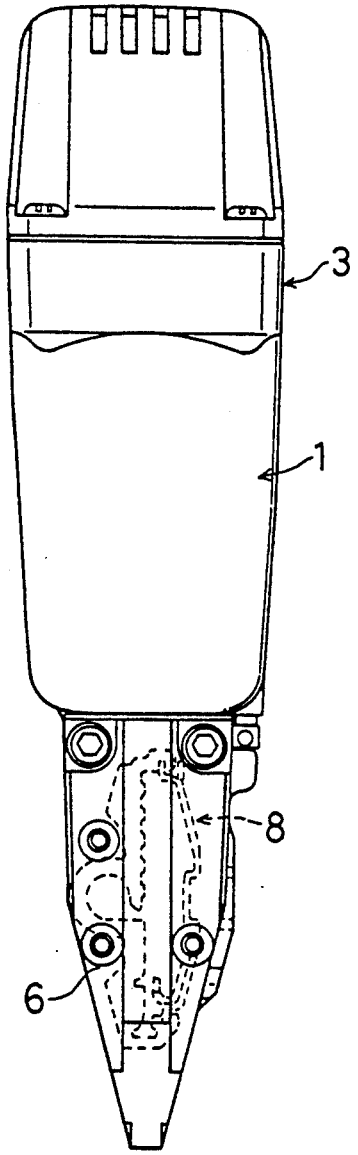
FIG. 2 is a front view of the nailing machine shown in FIG. 1.
Figure 4:
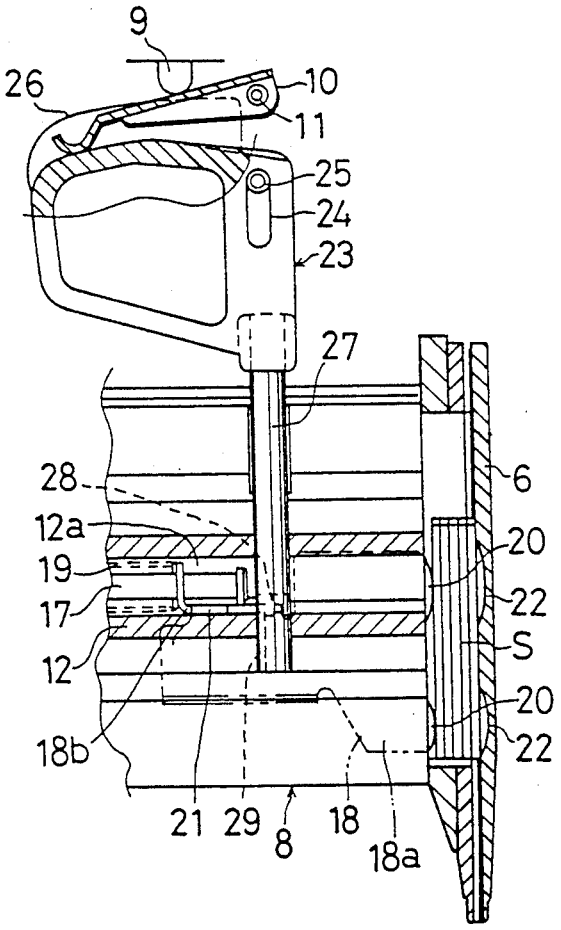
FIG. 4 is a left side view of a main part of the nailing machine shown in FIG. 1.
Figure 5:
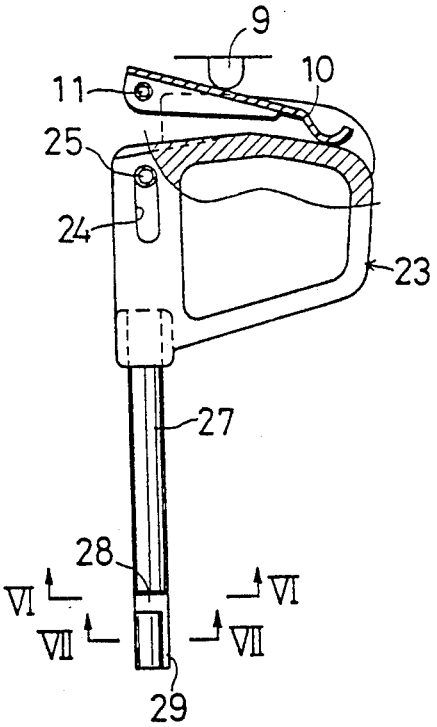
FIG. 5 is an enlarged right side view of a trigger shown in FIG. 1 with its associated members.
Figure 6:
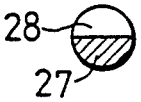
FIG. 6 is a sectional view taken along line VI—VI in FIG. 5.
Figure 7:
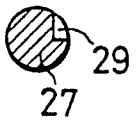
FIG. 7 is a sectional view taken along line VII—VII in FIG. 5.
Figure 8:
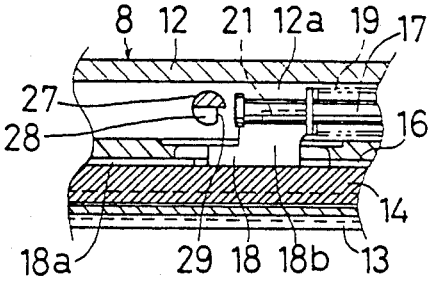
FIG. 8 is a plan view showing the relation between a stopper and a pusher shown in FIG. 1.

As shown in FIGS. 1 and 3, the nail magazine 8 includes a magazine body 12 which has a substantially U-shaped configuration turned sideways in section. Thus, the magazine body is opened at the left side thereof and includes a vertical nail guide wall 12*a* and a pair of horizontal walls 12*b* extending from the nail guide wall 12*a* at the upper end and the lower end thereof, respectively. A door plate 13 is mounted on the magazine body 12 with the upper and lower portions thereof slidably engaged with the upper and lower horizontal walls 12*b*, respectively, so as to close or open the left side of the magazine body 12. A nail guide plate 14 is mounted on the inner surface of the door plate 13 through engagement with a stopped portion (not shown) extending in a longitudinal direction of the door plate 13. The nail guide plate 14 is spaced from the nail guide wall 12*a* of the magazine body 12 to form a nail storing channel 16 therebetween. A pair of leaf springs 15 are interposed between the door plate 13 and the nail guide plate 14 so as to bias the nail guide plate 14 toward the nail guide wall 12*a*. A plurality of recesses 16*a* are formed in a longitudinal direction of the nail guide plate 14 and are spaced from each other in a vertical direction. A plurality of recesses 16*b* are formed in a longitudinal direction of the nail guide wall 12*a* and are opposed to the corresponding recesses 16*a* of the nail guide plate 14. Each pair of the recess 16*a* and the recess 16*b* opposed thereto functions to receive a head portion of the nail S and to guide the nail S in a longitudinal direction of the magazine body 12. Any of the pairs of the recess 16*a* and the recess 16*b* can be selectively used according to the length of the nail S to be driven.

As shown in FIG. 3, the nail guide wall 12*a* of the magazine body 12 includes a bore 12*c* formed at the middle position in a vertical direction of the magazine body 12 and extends in the longitudinal direction thereof. The bore 12*c* is communicated with the nail storing channel 16 through a slot 12*d*. A pusher rod 17 is disposed within the bore 12*c* and is fixed to the magazine body 12 at its rear end. A plate-like pusher 18 is disposed within the nail storing channel 16. The pusher 18 includes a vertical portion 18*a* disposed within the nail storing channel 16 and a horizontal portion 18*b* extending from the rear end of the vertical portion 18*a*. The horizontal portion 18*b* extends from the nail storing channel 16 into the bore 12*c* through the slot 12*d* and is slidably mounted on the pusher rod 17. Thus, the pusher 18 is movable in a longitudinal direction of the pusher rod 17. A coil spring 19 is mounted on the pusher rod 17 so as to bias the pusher 18 forwardly through the horizontal portion 18*b*, so that the nail S stored in the nail storing channel 18 are forced toward the nail guide channel 5 of the driver guide 6. The vertical portion 18*a* includes at the forward end thereof a pair of protrusions 20 for abutment on one of the nails S positioned at the most rearward position. The protrusions 20 are spaced from each other in a vertical direction. The nail guide channel 5 of the driven guide 6 includes a pair of recesses 22 corresponding to the protrusions 20 at a position opposed to the vertical portion 18*b* of the pusher 18. The horizontal portion 18*b* includes an engaging portion 21 for engagement with a stopper 27 as will be hereinafter explained.

Thus, the pusher 18 is positioned at its most forward position with the protrusions 20 engaged with the recesses 22 when no nails S exists in the nail storing channel 16.

A trigger 23 for actuation of the trigger valve 9 is disposed below the auxiliary trigger 10 and has a rectangular frame-like configuration. The trigger 23 includes a vertical elongated slot 24 formed in one side thereof. A support pin 25 is mounted on the support portion 3*a* of the housing body 3 is in engagement with the elongated slot 24 so as to provide a vertical guide for the trigger 23. A pair of flanged portions 26 are integrally formed with the trigger 23 and extend upwardly to receive the auxiliary trigger 10 therebetween. The stopper 27 for engagement with the engaging portion 21 has a round rod-like configuration and is fixed to the lower end of the trigger 23. The trigger valve 9 is biased downwardly by a spring (not shown) and the trigger 23 is forced downwardly by the trigger valve 9 through the auxiliary trigger 10. The lower portion of the stopper 27 extends through the magazine body 12 into the nail storing channel 16 and includes a horizontal recess 28 and a vertical recess 29 for engagement with the engaging portion 21 of the pusher 18. The vertical recess 29 is formed on the stopper 27 on the side opposed to the engaging portion 21 and extends downwardly from the horizontal recess 28. The horizontal recess 28 and the vertical recess 29 are positioned in such a manner that the engaging portion 21 of the stopper 27 does not engage with either of the horizontal recess 28 and the vertical recess and permits upward movement of the stopper 27 when two or more nails S remain within the nail storing channel 16. The engaging portion 21 engages only the vertical recess 29 and also permits upward movement of the stopper 27 for actuation of the trigger 23 when only one nail S remains within the nail storing channel 16. The engaging portion 21 engages the horizontal recess 29 beyond the vertical recess 28 and prevents the stopper 27 from upward movement or prevents the trigger 23 from actuation when no nail S exists within the nail storing channel 16 and the protrusions 20 of the pusher 18 engage their corresponding recesses 22 of the nail guide channel 5 within the drive guide 6. A door knob 30 is provided at the rear end of the door plate 13.

The operation of the nailing machine of the above embodiment will now be explained with reference to FIGS. 8 to 13.

Figure 9:
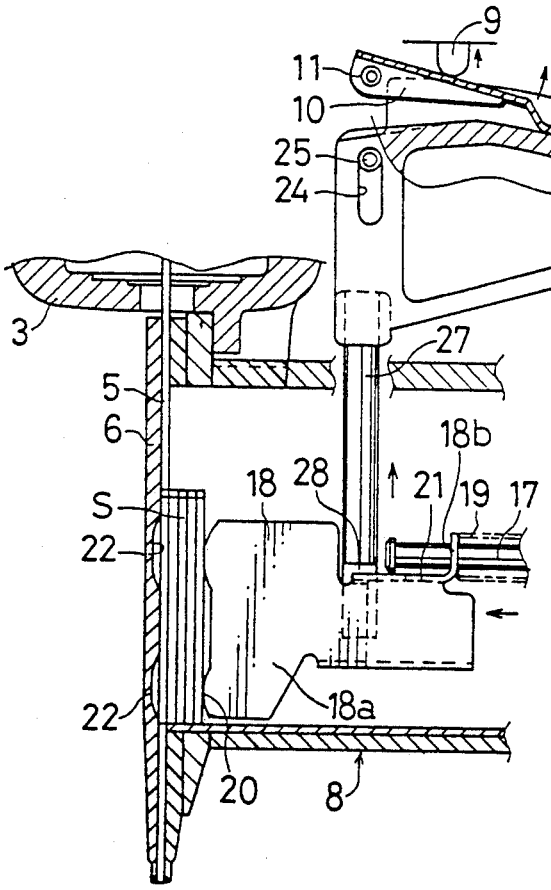
FIG. 9 is a right side view of FIG. 8.

In case two or more nails S remain within the nail storing channel 16 of the nail magazine 8 as shown in FIG. 9, the pusher 18 abuts, through the biasing force of the spring 19, on the nail S which is most rearwardly positioned. At this stage, the engaging portion 21 of the pusher 18 does not engage the vertical recess 28, and therefore, an operator is free to actuate the trigger 23. With the actuation of the trigger 23 through movement of engaging position of the elongated slot 23 with the pin 25, the trigger valve 9 is operated to be opened through movement of the auxiliary trigger 10. The driver 2 is moved by the air pressure to drive the nail S positioned within the nail guide channel 5 for one time. Upon releasing actuation of the trigger 23, the driving operation for one time is completed and the pusher 18 supplies the next nail S to be driven to the nail guide channel 5. Thus, the nail S stored within the nail storing channel 5 are in turn supplied to the nail guide channel 5 by the pusher 18, and the nail S are in turn driven into a work as the trigger 23 is actuated.

Figure 10:
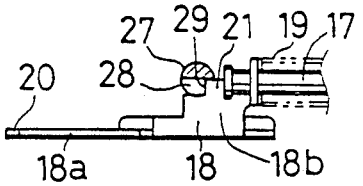
FIG. 10 is a view similar to FIG. 8 but showing a different operation.
Figure 11:
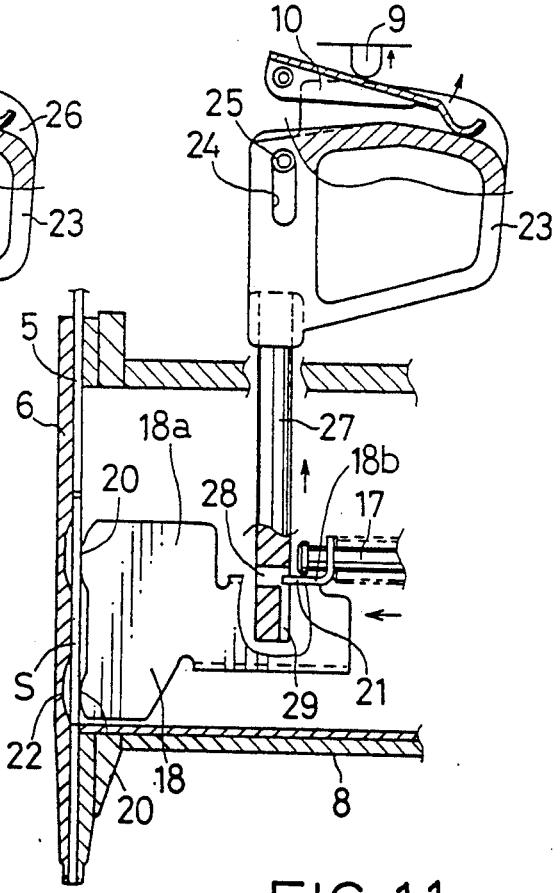
FIG. 11 is a right side view of FIG. 10.
Figure 12:
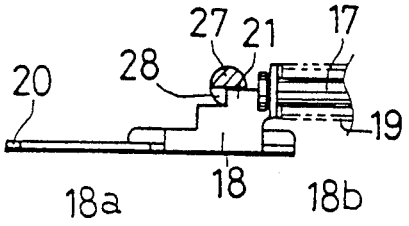
FIG. 12 is a view similar to FIG. 10 but showing a further different operation.
Figure 13:
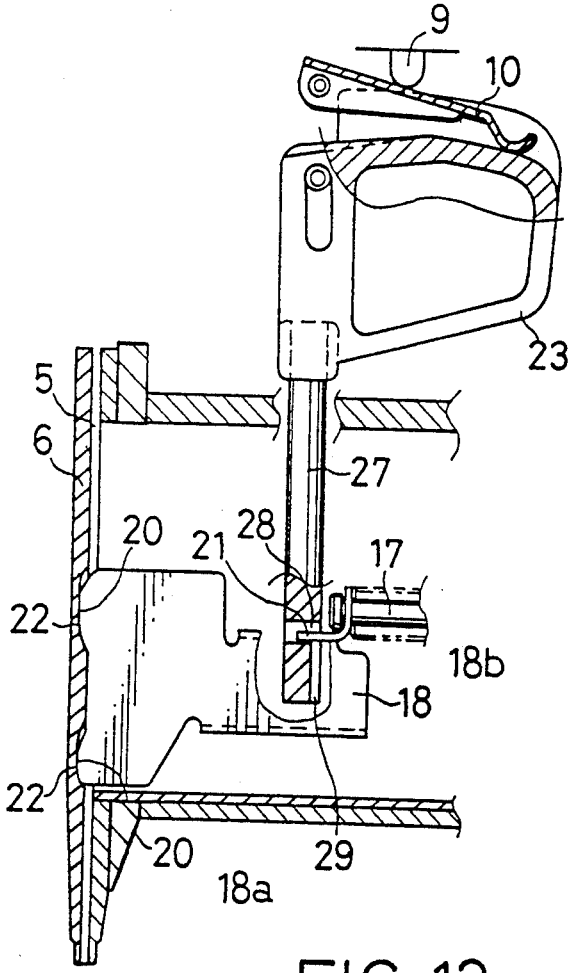
FIG. 13 is a right side view of FIG. 11.

In case only one nail S remains within the nail guide channel 5 of the driver guide 6 as shown in FIGS. 10 and 11, the pusher 18 abuts on the remaining nail S while the engaging portion 21 of the pusher 18 engages the vertical recess 29 of the stopper 27. At this stage, since the stopper 27 is permitted to move upwardly or the trigger 23 is permitted to be actuated, the trigger valve 9 may operate to be opened upon actuation of the trigger 23 through the auxiliary trigger 10, and the driving operation can be performed to drive the remaining nail S through the air pressure.

In case no nail S remains within the nail guide channel 16 after the above driving operation of the nails S, the protrusions 20 of the pusher 18 engage the corresponding recesses 22 of the nail guide channel 5 of the drive guide 6 while the engaging portion 21 of the pusher 18 engages the horizontal recess 28, so that the upward movement of the stopper 27 or the actuation of the trigger 23 may be prevented.

After the nail magazine 8 has been empty, new nails S can be incorporated into the nail storing channel 16 by moving the door plate 13 relative to the magazine body 12 in the longitudinal direction so as to open one side of the magazine body 12.

As described above, with this embodiment, the stopper 27 is formed with the horizontal recess 28 and the vertical recess 29 for engagement with the engaging portion 21 of the pusher 18. The stopper 27 is permitted to be moved upwardly or the trigger 23 is permitted to be actuated when the pusher 18 engages only the vertical recess 29 with the engaging member 21 of the pusher 18 abutted on the last one nail S which remains within the nail guide channel 5 of the driver guide 6. On the other hand, the stopper 23 may be prevented from actuation with the engaging portion 21 engaged with the vertical recess 28 when no nail S exists within the nail storing channel 16 and the protrusions 20 of the pusher 18 engage the corresponding recesses 22 of the nail guide channel 5 of the driver guide 6. Thus, with this embodiment, the stopper 27 can be reliably and smoothly engaged with the pusher 18 according to the state of no existence of the nail S within the nail storing channel 16.

Further, the nails S can be smoothly supplied to the nail guide channel 5 with the lateral side guided by the nail guide plate 14 biased by the leaf springs 15.

Although, with the above embodiment, the trigger 23 is prevented from actuation when the nail magazine 8 becomes empty, the engaging member 21 may be formed to have a larger size in a longitudinal direction of the pusher rod, so that the trigger 23 may be prevented from actuation when a predetermined number of nails S remain within the nail magazine 8.

A second embodiment of the present invention will now be explained with reference to FIGS. 14 to 15 in which the same members as the first embodiment are labeled by the same numerals with the suffix "A" thereafter.

A trigger 40 of the second embodiment has a U-shaped configuration in section. One end of the trigger 40 is pivotally supported by a support shaft 42 which is slidably and rotatably mounted on a bracket 41 integrally formed with a housing body 3A. An auxiliary trigger 10A is pivotally mounted on the upper portion of the trigger 40 through a pin 11A and is positioned in opposed relationship with a trigger valve 9A. A stopper pin 43 is mounted on the trigger 40 for preventing the auxiliary trigger 10A from rotation in one direction around the pin 11A.

Figure 15:
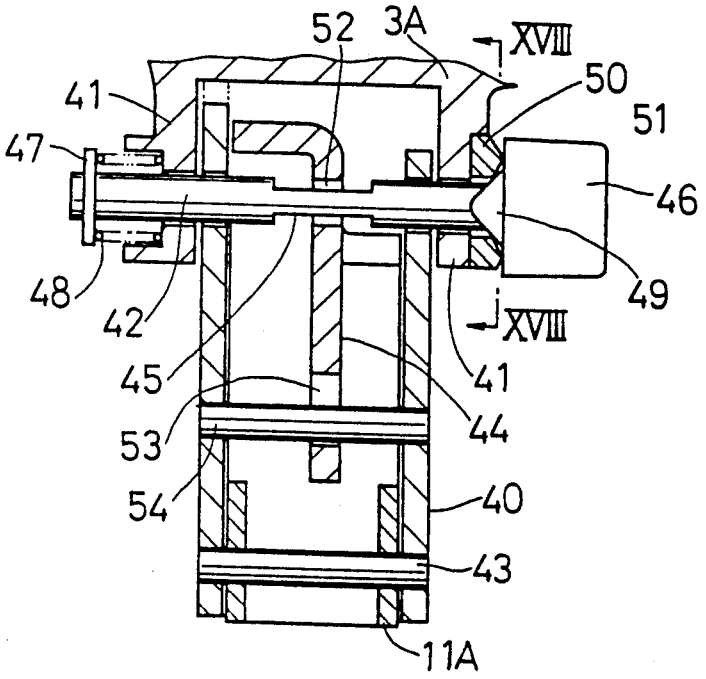
FIG. 15 is a view taken in the direction of arrow P in FIG. 14.

As shown in FIG. 15, the support shaft 42 includes at the middle position thereof a flat shaft portion 45 having substantially rectangular configuration in section for engagement with a safety lever 44 as will be hereinafter explained. One end of the support shaft 42 extends outwardly from the bracket 41 and is provided with a knob 46 for rotating the support shaft 42. The other end of the support shaft 42 also extends outwardly from the bracket 41 and is provided with a retaining ring 47 mounted thereon. A spring 49 is interposed between the retaining ring 47 and the bracket 41 so as to bias the support shaft 42 in a longitudinal direction thereof. The knob 46 includes on a side opposite to the bracket 41 a pair of rectangular protrusions 48 diametrically opposed to each other. A ring 50 is mounted on the bracket 41 on the side opposed to the knob 46 and includes four rectangular recesses 41 displaced from each other at an angle of 90°. Each of the recesses 41 corresponds to any of the protrusions 48 for engagement therewith. Thus, the protrusions 48 of the knob 46 engage any of two pairs of the recesses 51 as the support shaft 42 is rotated by the knob 48 at an angle 90°, so that the angular positions of the support shaft 42 can be selectively determined between a first position where the longer sides of the shaft portion 45 horizontally extends and a second position where they extend vertically.

Figure 17:
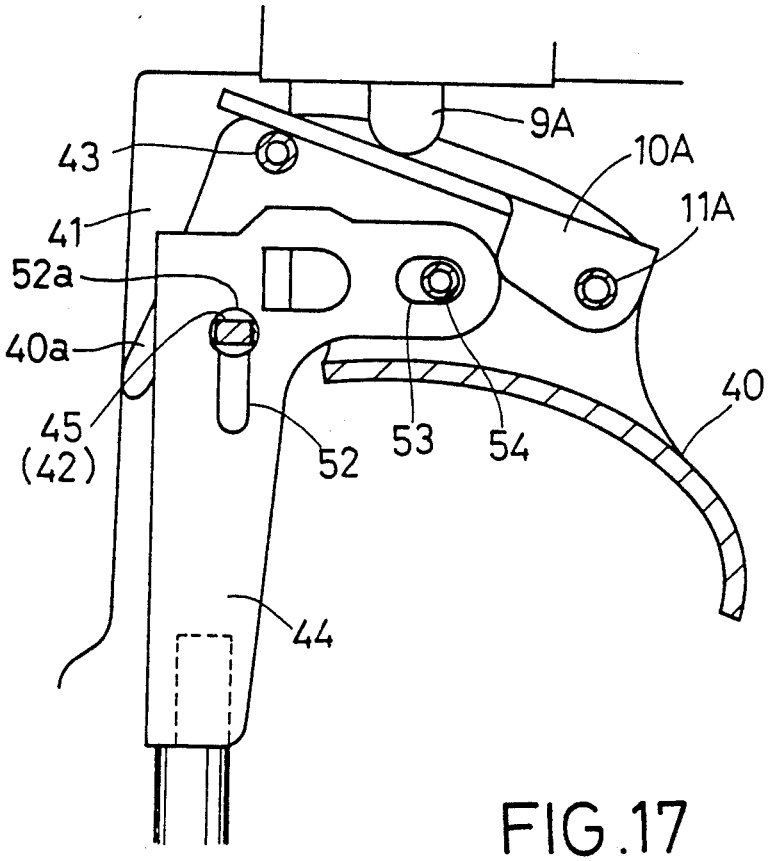
FIG. 17 is a view similar to FIG. 16 but showing a different operation.
Figure 18:
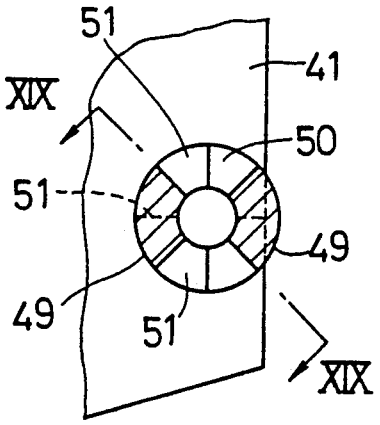
FIG. 18 is a sectional view taken along line XVIII—XVIII in FIG. 15.
Figure 19:
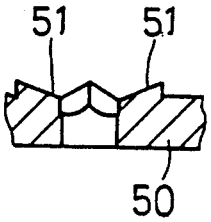
FIG. 19 is a sectional view taken along line XIX—XIX in FIG. 18.

The safety lever 44 has substantially L-shaped configuration and includes adjacent its bent portion a first elongated slot 52 extending in a vertical direction for engagement with the shaft portion 45 of the support shaft 42. A second elongated slot 53 is formed at the horizontal portion of the safety lever 44 and extends in the horizontal direction. A pin 54 is mounted on the trigger 40 and is in engagement with the second elongated slot 53. The first elongated slot 52 has a width which is slightly shorter than the length of the shorter sides of the shaft portion 45 but is longer than the length of the longer sides of the shaft portion 45, so that the safety lever 44 is permitted to move relative to the support shaft 42 when the shaft 45 engages the first elongated slot 52 with its longer sides positioned in parallel with the longitudinal direction of the first elongated slot 52. Thus, the safety lever 44 can be moved upwardly when it is lifted through engagement of the second elongated slot 53 with the pin 54 as the trigger 40 is drawn or rotated upwardly around the support shaft 42. The slot 52 includes at the upper portion thereof a circular slot 52*a* having a diameter substantially equal to the length of the longer sides of the shaft portion 45, so that the safety lever 44 may be prevented from movement relative to the support shaft 42 when the shaft portion 45 engages the circular slot 52 and is rotated to have its longer sides positioned vertically to the longitudinal direction of the first elongated slot 52. The trigger 40 may be prevented from rotation at the same time with such prevention of movement of the safety lever 44 since the trigger 40 can not be rotated unless the safety lever 44 is moved upwardly. The trigger 40 has a stopper portion 40*a* which may abut on the body housing 3A so as to prevent further returning movement of the trigger 40 by the spring force derived from the trigger valve 9A as described in the first embodiment when the shaft portion 45 engages the circular slot 52 (see FIG. 17).

Figure 14:
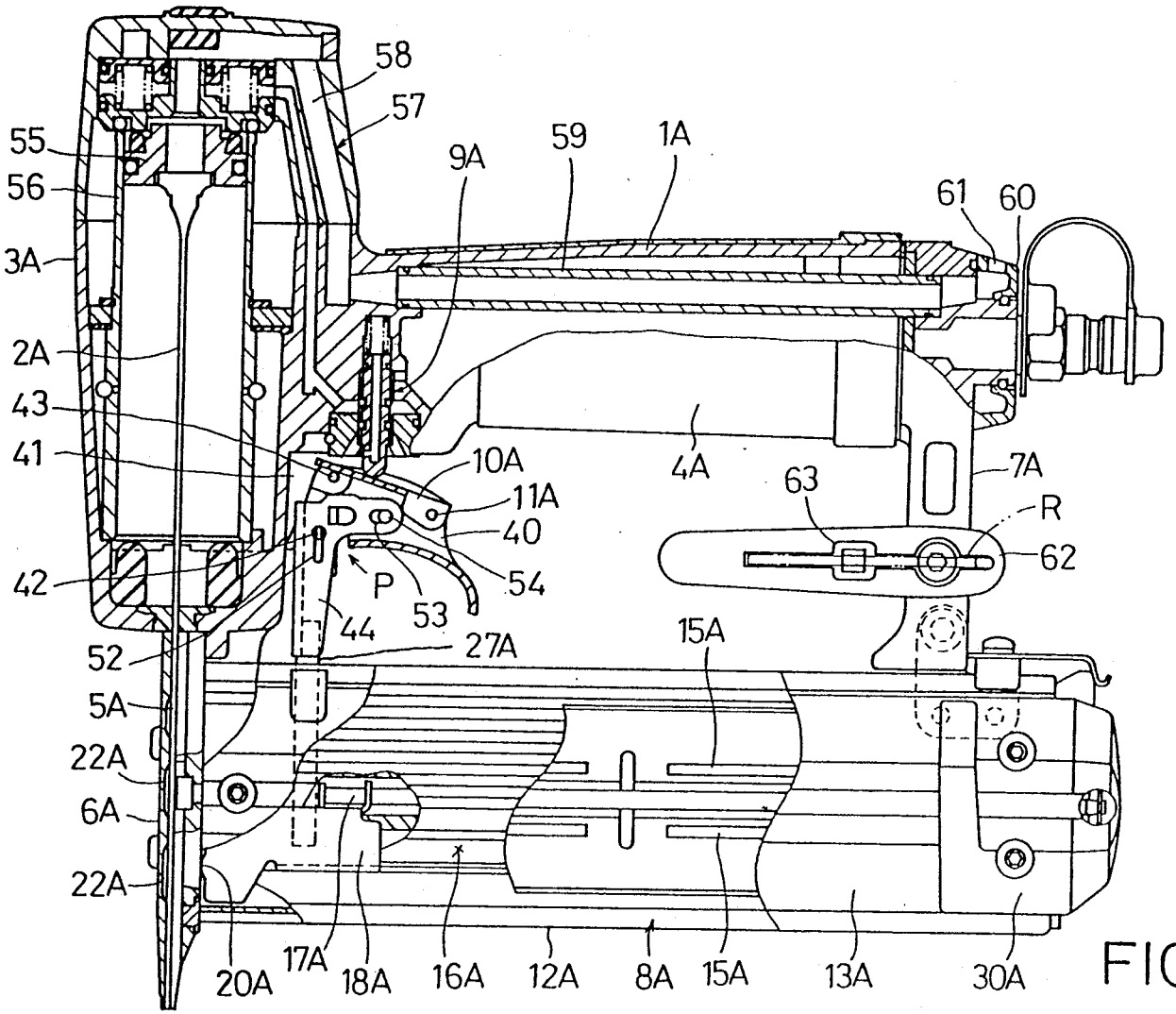
FIG. 14 is a right side view, with a part broken away, of a nailing machine according to a second embodiment of the present invention.

Meanwhile, in this embodiment, a driver device for reciprocal movement of the driver 5A is shown in FIG. 14 and has a cylinder 56 disposed within the body 3A and a piston 55 reciprocally movable therewithin. The air used for driving the piston 55 may be exhausted from an outlet 61 to the outside through an exhaust channel 57 including a first channel 58 formed in the body housing 3A and a second channel 59 formed in a handle 4A. The outlet 61 is formed in a cover 60 coaxially rotatably mounted on the rear portion of the handle 4A. Thus, the direction of the outlet 61 can be selectively determined through rotation of the cover 60. A hook member 62 is mounted on a bracket 7A on which a nail magazine 8A is mounted. The hook member 62 is disposed in parallel with the handle 4A and is applied for engagement with a belt of an operator, etc., so that the whole of a nailing machine 1A can be suspended from the belt. The hook member 62 includes a storage 63 for storing a tool such as a wrench R for adjusting the driving depth of the nail S.

Figure 16:
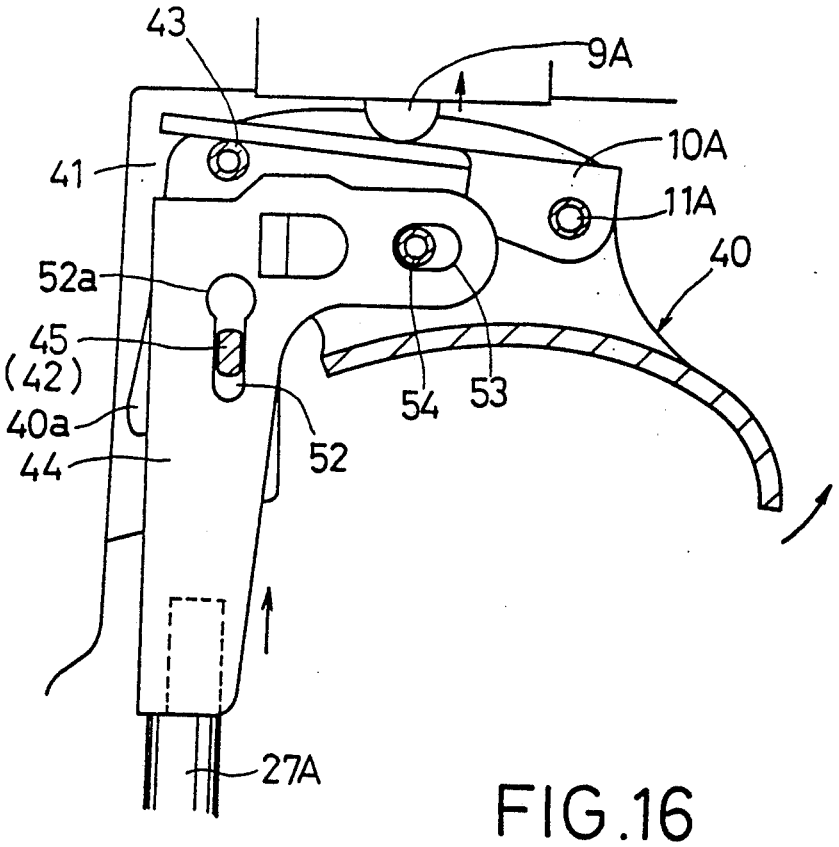
FIG. 16 is a partly enlarged view of FIG. 14 showing the relation between a trigger and a safety lever.

Thus, with the second embodiment, by adjusting the knob 46 to position the shaft portion 45 of the support shaft 42 within the circular slot 52*a* in such a manner that the longer sides of the shaft portion 45 extends parallel with the first elongated slot 52 as shown in FIG. 16, the trigger 40 can be actuated for movement of the safety lever 44 as well as the movement of the trigger valve 9A through an auxiliary trigger 10A.

On the other hand, by adjusting the knob 46 to position the shaft portion 45 within the circular slot 52*a* in such a manner that the longer sides of the shaft portion 45 extends vertically to the first elongated slot 52, the shaft portion 45 may be prevented from movement into the first elongated slot 52, so that the actuation of the trigger can be prevented. This may ensure security when the operator carries the nailing machine 1A with the nailing machine 1A hooked to the belt. The other operation is the same as the first embodiment.

While the invention has been described with reference to preferred embodiments, it is to be understood that modifications or variation may be easily made without departing from the spirit of this invention which is defined by the appended claims.

What is claimed is:

1. A nail machine comprising:

a body;

a driver guide mounted on said body and including a nail guide channel therein;

a driver reciprocally movable within the driver guide by a drive device disposed within said body;

a nail magazine mounted on said driver guide and including therein a nail storing channel in communication with said nail guide channel;

a pusher disposed within the nail storing channel for pressing nails stored therein toward said nail guide channel in such a manner that each nail can be in turn driven out of said nail guide channel by the reciprocal movement of said driver, the pusher being movable within said nail storing channel according to the amount of nails stored within said nail storing channel;

a trigger mounted on said body and operable by an operator to move between a starting position for actuating said drive device of said driver and a stopping position for stopping the same;

a stopper directly connected with said trigger at one end and having an engagement portion at the other end, said stopper movable between a first position corresponding to the starting position of said trigger and a second position corresponding to said stopping position in such a manner that said stopper is moved from said second position to said first position in response to the actuation of said trigger from said stopping position to said starting position; and said pusher including an engaging member disposed within the nail magazine and movable with the pusher, said engaging member being engageable with the stopper engagement portion when positioned at the second position so as to prevent movement of the trigger from said stopping position to said starting position when the amount of the nails stored within said nail storing channel is less than a predetermined amount.

2. A nailing machine comprising:

a body;

a driver guide mounted on said body and including a nail guide channel therein;

a driver reciprocally movable within said driver guide by a drive device disposed within said body;

a nail magazine mounted on said driver guide and including therein a nail storing channel in communication with said nail guide channel;

a pusher disposed with said nail storing channel for pressing nails stored therein toward said nail guide channel in such a manner that the nails can be in turn driven out of said nail guide channel by the reciprocal movement of said driver, said pusher being movable within said nail storing channel according to the amount of nails stored within said nail storing channel;

a trigger mounted on said body and operable by an operator to move between a starting position for actuating said drive device of said driver and a stopping position for stopping the same;

a stopper forming an integral part with said trigger and movable between a first position corresponding to said starting position of said trigger and a second position corresponding to said stopping position in such a manner that said stopper is moved from said second position to said first position in response to the actuation of said trigger from said stopping position to said starting position; and an engaging member disposed within said nail magazine and movable with said pusher, said engaging member being engagement with said stopper when positioned at said second position so as to prevent movement of said trigger from said stopping position to said starting position when the amount of the nails stored within said nail storing channel is less than a predetermined amount;

said nail storing channel of said nail magazine extending substantially perpendicular to said nail guide channel of said driver guide;

said pusher being movable within said nail storing channel in a longitudinal direction thereof;

said stopper extending from said trigger perpendicular to said nail storing channel to said nail magazine and has one end fixedly connected with said trigger and the other end extended within said nail storing channel through said nail magazine for engagement with said engaging member;

said one end of said stopper including a slot at a position opposed to said engaging member in a longitudinal direction of said nail storing channel for engagement with said engaging member;

said slot of said one end of said stopper including a first slot formed perpendicular to a longitudinal direction of said stopper and a second slot extending from said first slot in the longitudinal direction of said stopper;

said second slot being formed on a side of said one end of said stopper opposed to said engaging member;

said engaging member engaging only said second slot so as to permit movement of said stopper from said second position to said first position when the amount of said nails exceeds at least said predetermined amount; and said engaging member engaging said first slot beyond said second slot so as to prevent movement of said stopper from said second position to said first position when the amount of said nails is less than said predetermined amount.

3. A nailing machine comprising:

a body;

a driver guide mounted on said body and including a nail guide channel therein;

a driver reciprocally movable within said driver guide by a drive device disposed within said body;

a nail magazine mounted on said driver guide and including therein a nail storing channel in communication with said nail guide channel;

a pusher disposed with said nail storing channel for pressing nails stored therein toward said nail guide channel in such a manner that the nails can be in turn driven out of said nail guide channel by the reciprocal movement of said driver, said pusher being movable within said nail storing channel according to the amount of nails stored within said nail storing channel;

a trigger mounted on said body and operable by an operator to move between a starting position for actuating said drive device of said driver and a stopping position for stopping the same;

a stopper forming an integral part with said trigger and movable between a first position corresponding to said starting position of said trigger and a second position corresponding to said stopping position;

an engaging member disposed within said nail magazine and movable with said pusher, said engaging member being engageable with said stopper positioned at said second position so as to prevent movement of said trigger from the second position to said first position when the amount of the nails stored within said nail storing channel is less than a predetermined amount; said nail storing channel of said nail magazine extends substantially perpendicular to said nail guide channel of said driver guide; said pusher is movable within said nail storing channel in a longitudinal direction thereof; and said stopper extend from said trigger perpendicular to said nail storing channel of said nail magazine and has one end fixedly connected with said trigger and the other end extended within said nail storing channel through said nail magazine for engagement with said engaging member; said one end of said stopper includes a recess at a position opposed to said engaging member in a longitudinal direction of said nail storing channel for engagement with said engaging member; and said stopper is a round rod-like member; said recess of said one end of said stopper includes a first recess formed perpendicular to a longitudinal direction of said stopper and a second recess extending from said first recess in the longitudinal direction of said stopper; said second recess is formed on a side of said one end of said stopper opposed to said engaging member; said engaging member engages only said second recess so as to permit movement of said stopper from said second position to said first position when only one nail exists in said nail storing channel; said engaging member engages said first recess beyond said second recess so as to prevent movement of said stopper from said second position to said first position when no nail exists in said nail storing channel.

* * * * *